US006731322B2

(12) United States Patent
Hori

(10) Patent No.: US 6,731,322 B2
(45) Date of Patent: May 4, 2004

(54) EXPOSING APPARATUS

(75) Inventor: Hisamitsu Hori, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/879,132

(22) Filed: Jun. 13, 2001

(65) Prior Publication Data

US 2001/0052926 A1 Dec. 20, 2001

(30) Foreign Application Priority Data

Jun. 14, 2000 (JP) ..... 2000-178945

(51) Int. Cl.[7] ..... B41J 2/45
(52) U.S. Cl. ..... 347/238
(58) Field of Search ..... 347/238, 244, 347/258, 241, 256, 130, 134; 438/69, 99; 430/383, 391

(56) References Cited

U.S. PATENT DOCUMENTS 5,482,896 A * 1/1996 Tang ..... 437/209
5,688,551 A * 11/1997 Littman et al. ..... 427/64
5,792,579 A * 8/1998 Phillips ..... 430/7
5,952,037 A * 9/1999 Nagayama et al. ..... 427/66
6,121,993 A 9/2000 Maekawara et al.
6,336,836 B1 * 1/2002 Suzuki et al. ..... 445/6
6,522,350 B2 * 2/2003 Inoue et al. ..... 347/238
6,670,979 B2 * 12/2003 Inoue et al. ..... 347/238

FOREIGN PATENT DOCUMENTS

| | | | |
|---|---|---|---|
| EP | 916 506 A2 | * | 5/1999 |
| JP | 11-129541 | | 5/1999 |
| JP | 2000-052592 | | 2/2000 |
| JP | 2001-042790 | * | 2/2001 |

* cited by examiner

*Primary Examiner*—Michael Nghiem
(74) *Attorney, Agent, or Firm*—Sughrue Mion, PLLC

(57) ABSTRACT

Unevenness due to dispersion of properties among organic electroluminescent devices is prevented to form an optimal light emission form for exposure. The organic EL devices in lines R1, R2 and R3 have respectively different x-coordinates and move relatively in a y-axis direction with respect to a photosensitive material at a time of exposure to form a horizontal scan line R-all by the exposure. Similarly, lines R4, R5 and R6 further form the horizontal scan line R-all. Thus, the horizontal scan line R-all is exposed twice: by the lines R1, R2 and R3, and by the lines R4, R5 and R6.

28 Claims, 8 Drawing Sheets

EXPOSING APPARATUS

BACKGROUND OF THE INVENTION

1. Field of the Invention

The present invention relates to an exposing apparatus, and more particularly to an exposing apparatus using organic electroluminescent devices (hereinafter referred to as "organic EL devices") to expose a photosensitive material.

2. Description of the Related Art

Presently, array-type light sources for exposing a photosensitive material to record an image which employ light emitting diodes (LED), VF (Vacuum Fluorescent), organic EL devices, and the like, are being investigated.

An LED array has small errors in distances between LED devices within a chip, however, since the array is formed by jointing a plurality of chips, errors at joints in a direction in which the LED devices are arranged are large. That is, errors in distances between devices of different chips are large. Further, since wavelength and light intensity of LED devices largely depend on temperature, unevenness is likely to be caused and it is difficult to mount LED devices having different wavelengths on the same substrate. In addition, only LED arrays which emit red light have been presented.

A VF device includes a wire and a number of electrodes arranged so as to face the wire. However, the wire is slackened when it is long and, because of the limitation of the wire, it is difficult to make a long size VF, such as an A3 size VF. Further, hysteresis is likely to be caused by use of thermoelectrons. In addition, since either of the devices has a complex structure, it is difficult to arrange a number of devices in two dimension.

In contrast, organic EL devices, for which attempts for practical application have been remarkable in recent years, are excellent in the above-described points. However, organic EL devices have problems such as dispersion in properties such as light intensity, wavelength, light emission patterns between devices, change of light intensity over time, and the like, and are not sufficient for use for high quality images.

Correction techniques such as measurement of light intensity for each pixel and microscopic measurement of print density have been presented. However, the number of pixels to be corrected is several thousands for A3 width at 400 dpi (dots per inch), and it is still difficult to obtain sufficient image quality even when these pixels have been corrected.

SUMMARY OF THE INVENTION

In order to solve the above-described problems, an object of the present invention is to provide an exposing apparatus in which unevenness due to dispersion of properties among organic electroluminescent devices is prevented to form an optimal light emission pattern for exposure.

A first aspect of the present invention is an exposing apparatus including: a transparent substrate; and a plurality of rows of organic electroluminescent devices, each row including the organic electroluminescent devices disposed according to a predetermined spacing, the rows being disposed on a surface of the transparent substrate and displaced relative to each other, such that each organic electroluminescent device in one of the rows at least partially overlaps at least one organic electroluminescent device in another of the rows with respect to the direction of the rows.

There is slight dispersion in properties such as light intensity, wavelength, light emission form, and the like among the organic electroluminescent devices. Therefore, the organic electroluminescent devices are shifted relative to each other in the direction of arrangement so that at least portions of the respective organic electroluminescent devices are overlapped in the direction perpendicular to the direction of arrangement. Thereby, the dispersion of properties among the organic electroluminescent devices of different lines is cancelled and generally uniform properties can be obtained over the entire arrangements.

The position of each organic electroluminescent device in one of the rows may substantially correspond to the position of at least one organic electroluminescent device in another of the rows with respect to the direction of the rows, and a pixel may be formed using at least two of the organic electroluminescent devices.

The organic electroluminescent devices may include at least two types, each type arranged in rows according to the predetermined spacing, each row of the first type being offset by a predetermined amount with respect to the direction of the rows relative to each row of the second type so as to form a plurality of linear arrays of different organic electroluminescent device types on the transparent substrate, wherein the types of organic electroluminescent devices emit light in mutually different wavelength ranges, the transparent substrate consists essentially of a single substrate, and the arrays are shifted relative to each other such that each organic electroluminescent device in the array of one type of organic electroluminescent devices at most partially overlaps an organic electroluminescent device in the array of another type of organic electroluminescent devices with respect to the direction of the rows.

Further, the exposing apparatus may include a lens array including a plurality of lenses arranged opposing the rows so as to form lens rows, the positions of the lenses being shifted relative to each other from one lens row to another such that each lens in one of the lens rows at most partially overlaps a lens in another of the lens rows with respect to the direction of the rows, and the lenses being adapted for exposing a photosensitive material with light emitted from the organic electroluminescent devices.

In addition, the exposing apparatus may include an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

A second aspect of the present invention is an apparatus for exposing a photosensitive material, the apparatus including: a substrate; and a set of element rows formed by arranging a plurality of rows on the substrate in a direction substantially perpendicular to the rows, each row being formed by arranging a plurality of elements which emit light in the same wavelength range along the direction of the rows, the elements being spaced at first intervals, and the rows being displaced relative to each other with respect to the direction of the rows at second intervals which are smaller than the first intervals.

DESCRIPTION OF THE PREFERRED EMBODIMENTS

Hereinafter, embodiments of the present invention are described in detail with reference to FIGS. 1 to 8.

First Embodiment

Figure 1:
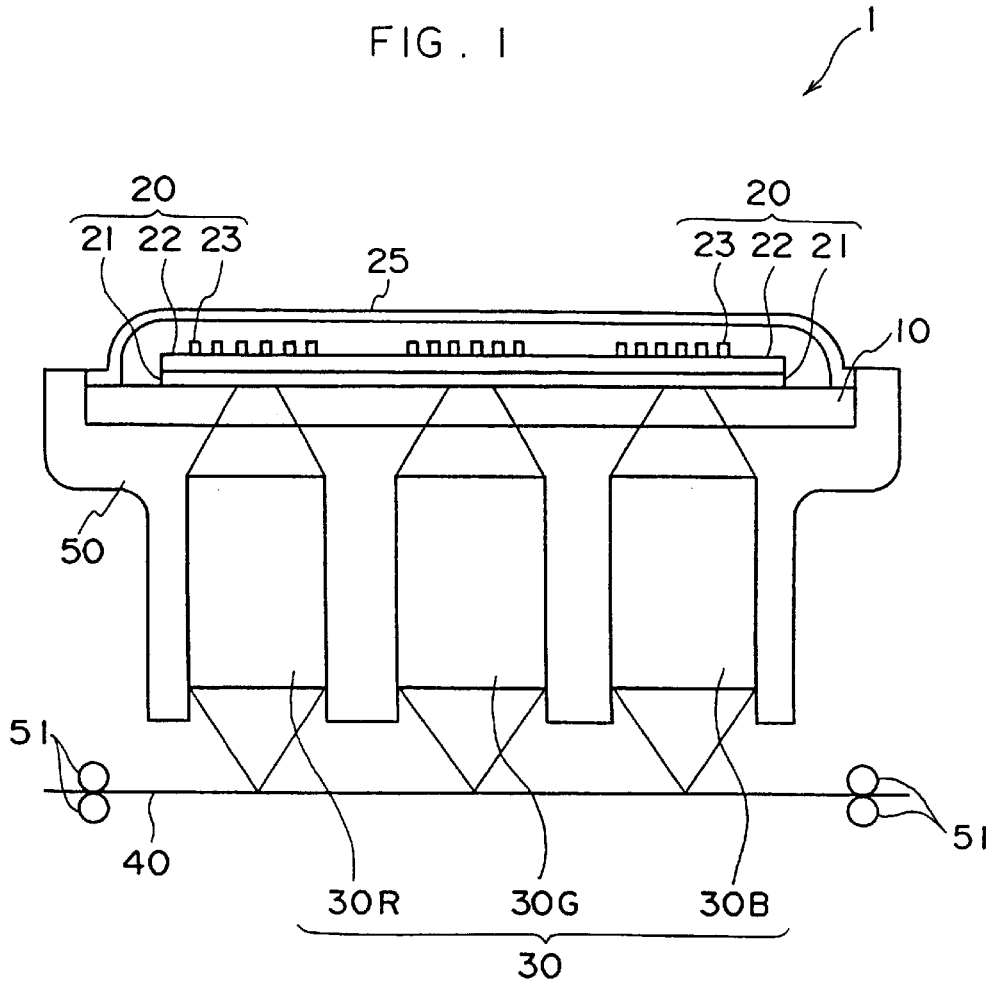
FIG. 1 is a sectional view showing a structure of an exposing apparatus relating to an embodiment of the present invention.

As shown in FIG. 1, an exposing apparatus 1 relating to the present embodiment is provided with a transparent substrate 10, organic EL devices 20 formed on the transparent substrate 10 by vapor deposition, a SELFOC lens array 30 (30R, 30G, and 30B) for converging light emitted from the organic EL devices 20 to irradiate a photosensitive material 40, and a support 50 for supporting the transparent substrate 10 and SELFOC lens array (hereinafter referred to as "SLA") 30.

The organic EL devices 20 are formed of a transparent anode 21, an organic compound layer 22 including a light emitting layer, and metal cathodes 23 sequentially laminated on the transparent substrate 10 by vapor deposition. The organic EL devices 20 are covered with a sealing member 25 such as a stainless steel cover, or the like, as shown in FIG. 1. Marginal portions of the sealing member 25 and the transparent substrate 10 are bonded together, and the organic EL device 20 is enclosed in the sealing member 25, which is filled with dry nitrogen gas. When a predetermined voltage is applied between the transparent anode 21 and the metal cathodes 23 of the organic EL devices 20, the light emitting layer included in the organic compound layer 22 emits light and the emitted light passes out through the transparent anode 21 and the transparent substrate 10. The organic EL devices 20 are excellent in stability of wavelength.

The transparent anode 21 has a light transmittance of at least 50%, preferably 70% or more, in a wavelength range of visible light between 400 nm and 700 nm. As a material for forming the transparent anode 21, a compound known as a transparent electrode material, such as tin oxide, indium tin oxide (ITO), indium zinc oxide, or the like, or a thin film formed of a metal having a large work function, such as gold, platinum, or the like, can be used. Further, an organic compound such as polyaniline, polythiophene, polypyrrole, or the like, or a derivative thereof can also be used. A transparent conductive film is described in detail in "Tomei-doden-maku no Shintenkai" (New Developments of Transparent Conductive Films), supervised by Yutaka Sawada, published by CMC (1999), and can be applied for the present invention. The transparent anode 21 can also be formed on the transparent substrate 10 by vacuum deposition, sputtering, ion plating, or the like.

The organic compound layer 22 may have a single layer structure consisting only of the light emitting layer, or a laminated structure including the light emitting layer and other layers such as a hole injection layer, a hole transfer layer, an electron injection layer, an electron transfer layer, and the like, as necessary. Specific examples of a structure of the organic compound layer 22 (including electrodes) include anode-hole injection layer-hole transfer layer-light emitting layer-electron transfer layer-cathode, anode-light emitting layer-electron transfer layer-cathode, anode-hole transfer layer-light emitting layer-electron transfer layer-cathode, and the like. More than one light emitting layer, hole transfer layer, hole injection layer, and electron injection layer may be provided respectively.

The metal cathodes 23 are preferably formed of a metallic material having a low work function, for example, an alkali metal such as Li, K, or the like, an alkali earth metal such as Mg, Ca, or the like, or an alloy or mixture of these metals and Ag, Al, or the like. In order to obtain both a good preservation stability and a good electron injection property at the cathode, an electrode formed of the above listed material may be coated with Ag, Al, Au, or the like, which has a large work function and a high conductivity. Similar to the transparent anode 21, the metal cathodes 23 can be formed by a known method such as vacuum deposition, sputtering, ion plating, or the like.

Figure 2:
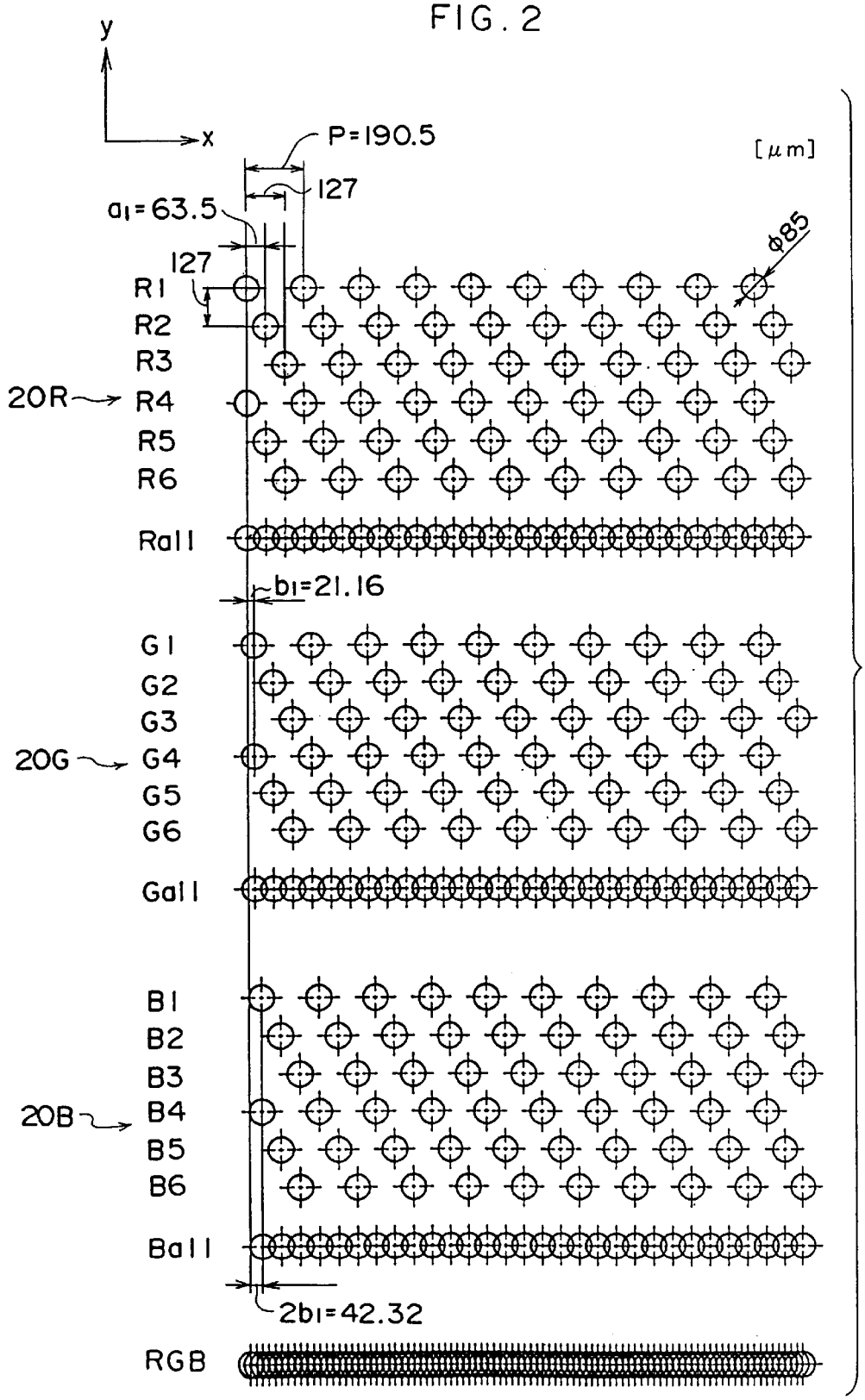
FIG. 2 a schematic view showing an arrangement of organic EL devices formed on a transparent substrate of the exposing apparatus.

As shown in FIG. 2, organic EL devices 20R for emitting red light, organic EL devices 20G for emitting green light and organic EL devices 20B for emitting blue light are formed on the transparent substrate 10.

The organic EL devices 20R are arranged in six lines or rows R1 to R6 which are parallel in an x-axis direction. A distance P between the adjacent organic EL devices 20R in a direction of arrangement of each line (the x-axis direction) is, for example, 190.5 $\mu$m. The line R2 is shifted relative to the line R1 in the x-axis direction by a distance al (=P/3=63.5 $\mu$m). The line R3 is shifted relative to the line R2 in the x-axis direction by the distance al. Similarly, the lines R4, R5 and R6 are shifted relative to each other in the x-axis direction by the distance al respectively. Positions along the x-axis of the organic EL devices 20R in the line R1 and in the line R4 are the same. Similarly, positions along the x-axis of the organic EL devices 20R in the line R2 and in the line R5, as well as in the line R3 and in the line R6 are respectively the same.

The organic EL devices 20R in the lines R1, R2 and R3 have respectively different x coordinates, and move in a y-axis direction with respect to the photosensitive material 40 during exposure so as to form a horizontal scan line R-all by the exposure, as shown in FIG. 2. Similarly, the lines R4, R5 and R6 form the horizontal scan line R-all by exposure. Thus, the horizontal scan line R-all is formed by the three lines R1, R2 and R3. Further, the horizontal scan line R-all is also formed by the three lines R4, R5 and R6.

Similarly to the organic EL devices 20R, organic EL devices 20G are arranged in six lines G1 to G6 which are parallel in the x-axis direction. The lines G1 through G6 are respectively shifted relative to the lines R1 through R6 in the x-axis direction by a distance b1 (=21.16 $\mu$m).

The organic EL devices 20G in the lines G1, G2 and G3 have respectively different x coordinates, and move in the y-axis direction with respect to the photosensitive material 40 during exposure so as to form a horizontal scan line G-all by the exposure, as shown in FIG. 2. Similarly, the lines G4, G5 and G6 form the horizontal scan line G-all by exposure. Thus, the horizontal scan line G-all is formed by the three lines G1, G2 and G3. Further, the horizontal scan line G-all is also formed by the three lines G4, G5 and G6.

Similarly to the organic EL devices 20R and 20G, organic EL devices 20B are arranged in six lines B1 to B6 which are parallel in the x-axis direction. The lines B1 through B6 are respectively shifted relative to the lines R1 through R6 in the x-axis direction by a distance 2*b*1 (=42.32 μm).

The organic EL devices 20B in the lines B1, B2 and B3 have respectively different x coordinates, and move in the y-axis direction with respect to the photosensitive material 40 during exposure so as to form a horizontal scan line B-all by the exposure, as shown in FIG. 2. Similarly, the lines B4, B5 and B6 form the horizontal scan line B-all by exposure. Thus, the horizontal scan line B-all is formed by the three lines B1, B2 and B3. Further, the horizontal scan line B-all is also formed by the three lines B4, B5 and B6.

Here, if a number of colors used is $C_1$, a number of lines formed by organic EL devices for each color is $N_1$, and a number of lines of organic EL devices forming a single horizontal scan line during exposure is $M_1$, then al and b1 can be obtained from the following equations:

$$a1=P1/M_1$$

and $$b1=a1/C_1=P1/(C_1 \cdot M_1),$$

wherein $M_1 \geqq 1$, $N_1 \geqq 2$ and $C_1 \geqq 1$.

Figure 3:
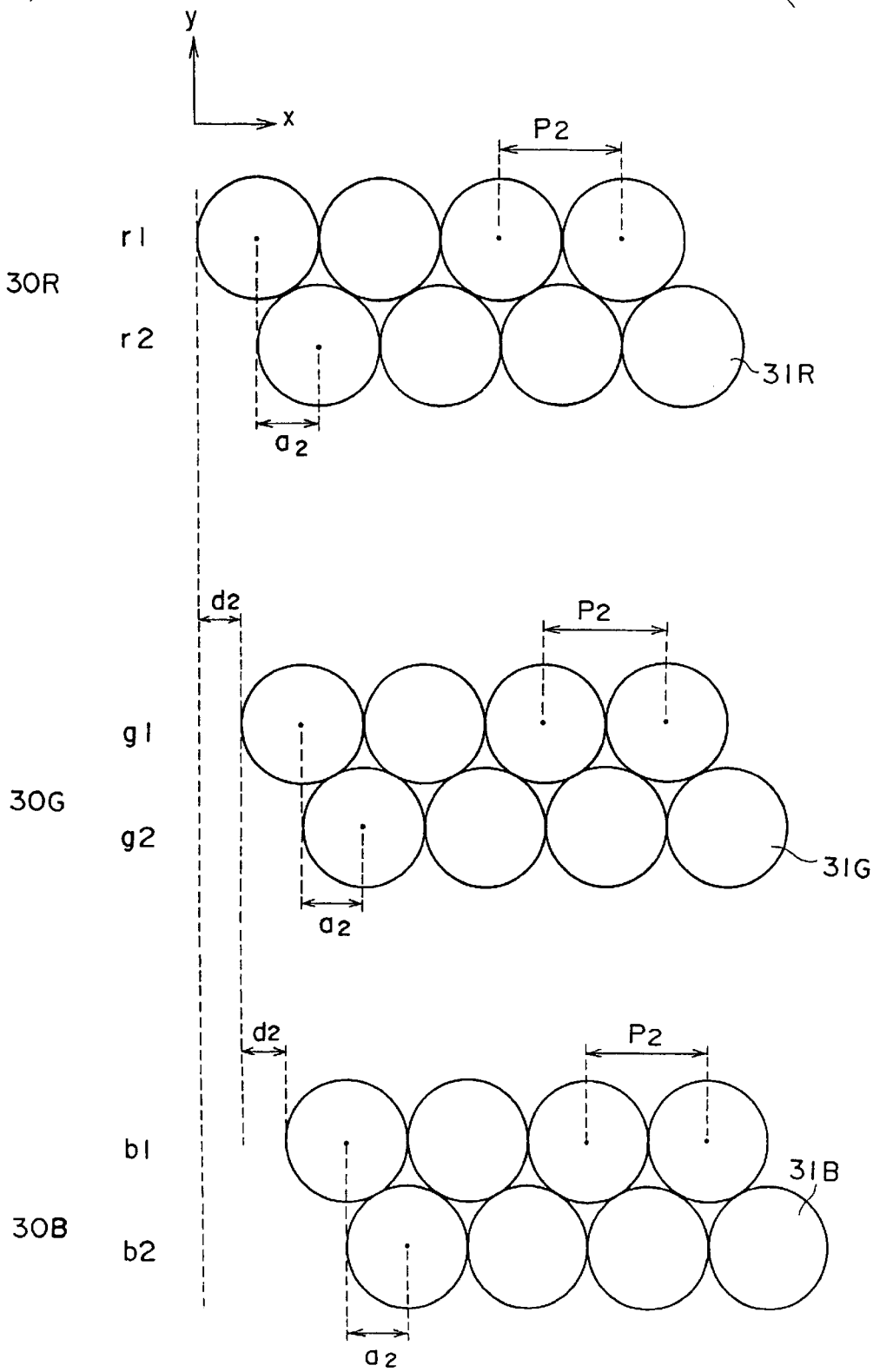
FIG. 3 is a view showing an arrangement of SELFOC lenses forming SLAs of the exposing apparatus.

As shown in FIG. 3, SLAs 30R, 30G and 30B respectively include a plurality of SELFOC lenses 31R, 31G and 31B. The SELFOC lenses 31R, 31G and 31B are stem-like thick lenses having refraction distributions in radial directions of their cross sections. Light rays entering the SELFOC lenses 31R, 31G and 31B proceed while respectively meandering in a sinusoidal wave form with respect to an optical axis and are output to the photosensitive material 40.

The SELFOC lenses 31R are arranged in two lines r1 and r2 which are parallel in the x-axis direction. A distance P2 between central axes of adjacent SELFOC lenses 31R is the same as a diameter of a cross section of each SELFOC lens. That is, the SELFOC lenses 31R are arranged so that the adjacent SELFOC lenses 31R are in contact with each other. The distance P2 is preferably 50 to 100 μm. The line r2 is shifted relative to the line r1 in the x-axis direction by a distance a2 (=a radius of the cross section).

Similarly to the SELFOC lenses 31R, the SELFOC lenses 31G are arranged in two lines g1 and g2 which are parallel in the x-axis direction. The lines g1 and g2 are respectively shifted relative to the lines r1 and r2 in the x-axis direction by a distance d2.

Similarly to the SELFOC lenses 31R and 31G, the SELFOC lenses 31B are arranged in two lines b1 and b2 which are parallel in the x-axis direction. The lines b1 and b2 are respectively shifted relative to the lines g1 and g2 in the x-axis direction by the distance d2.

If the number of colors used is $C_2$, the number of SLAs corresponding to one color is $N_2$, and the number of lines of SELFOC lenses forming one SLA is $M_2$, then a2 and d2 are given by the following equations:

$$a2=P2/M_2$$

and $$d2=a2 \cdot C_2=P2/(C_2 \cdot M_2).$$

Various types of photosensitive materials can be used as the photosensitive material 40. For example, if a silver halide color photosensitive material is used as the photosensitive material 40, a color image or textual information can be recorded on the photosensitive material 40. Further, a photosensitive heat sensitive material can also be used as the photosensitive material 40. The photosensitive material 40 is nipped by conveying rollers 51 and is conveyed in a predetermined conveying direction.

In the exposing apparatus 1 structured as described above, light emitted from the organic EL devices 20 is converged by the SLAs 30 and is irradiated onto the photosensitive material 40. Light intensity distributions on the photosensitive material 40 at this time are described below.

Figure 4A:
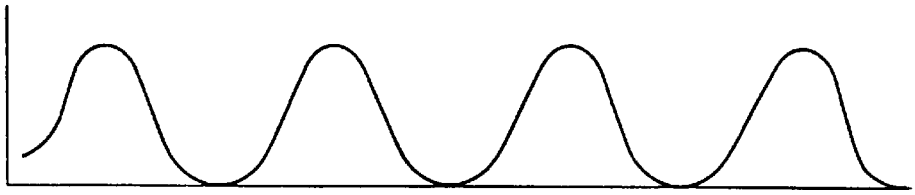
FIGS. 4A to 4D are views showing light intensity distributions for respective lines of the organic EL devices formed on the transparent substrate.
Figure 4B:
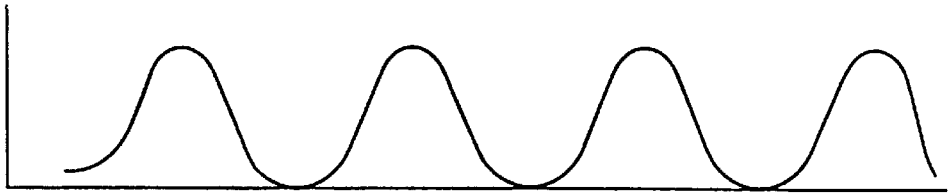
Figure 4C:
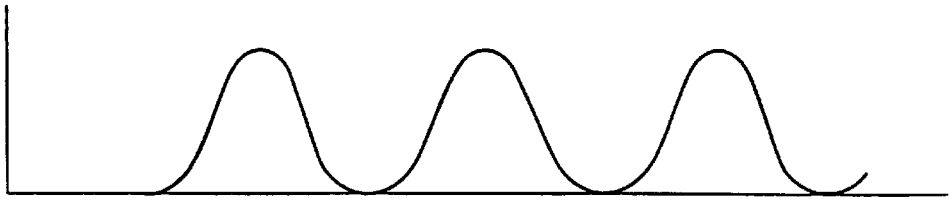
Figure 4D:
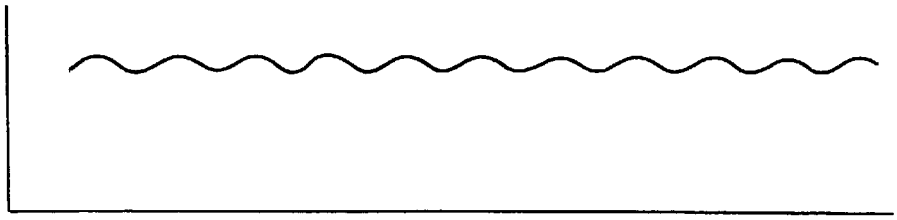

As shown in FIG. 4A, a light intensity distribution of the organic EL devices 20R in the line R1 is such that the light intensity is high at positions where the organic EL devices 20R are formed and forms a ripple. As shown in FIG. 4B, a light intensity distribution of the organic EL devices 20R in the line R2 is a displaced form of the distribution of the line R1. As shown in FIG. 4C, a light intensity distribution of the organic EL devices 20R in the line R3 is a further dispersed form of the distribution of the line R1. Therefore, as shown in FIG. 4D, a light intensity distribution of the horizontal scan line R-all formed by the lines R1, R2 and R3 forms a ripple which is smaller than the ripples of the lines R1, R2 and R3 and is almost uniform. The same is true for light intensity distributions of the organic EL devices 20G and 20B.

Therefore, by arranging the lines of the organic EL devices 20 to be shifted relative to each other by a predetermined distance, the exposing apparatus 1 can expose the photosensitive material 40 in a state such that ripples in the light intensity distribution are small, thereby obtaining a high quality image which does not have unevenness. In addition, crosstalk between adjacent pixels, which accompanies highly dense pixels, can be prevented.

During exposure, the first, fourth, seventh, etc. pixels in the horizontal scan line R-all are formed by light emission from the organic EL devices 20R in the lines R1 and R4. That is, these pixels are exposed twice, by the organic EL devices 20R in the line R1 and in the line R4. Similarly, other pixels in the horizontal scan line R-all are also exposed twice.

Since the plurality of parallel lines R1 to R6 of the organic EL devices 20R are arranged to be perpendicular to the conveying direction of the photosensitive material 40, the exposing apparatus 1 exposes each pixel with a plurality of the organic EL devices 20R, thereby preventing unevenness caused by dispersion of properties of the respective organic EL devices 20R.

Figure 5A:
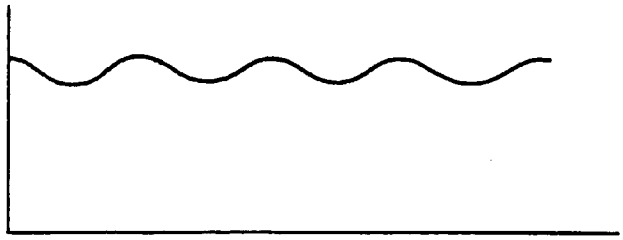
FIGS. 5A to 5D are views showing light intensity distributions for respective colors of lights emitted from the organic EL devices formed on the transparent substrate.
Figure 5B:
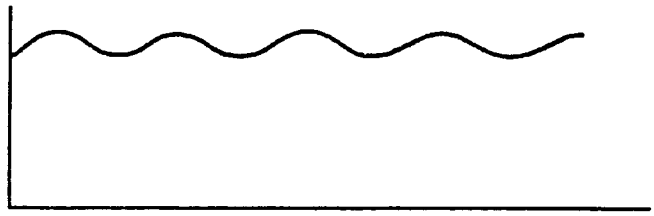
Figure 5C:
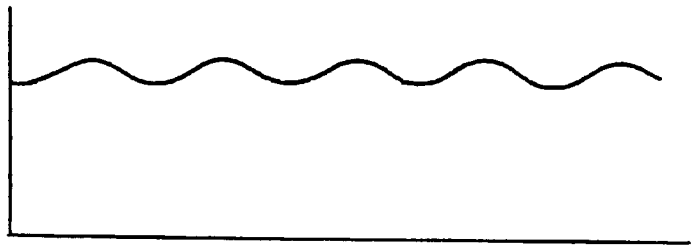
Figure 5D:
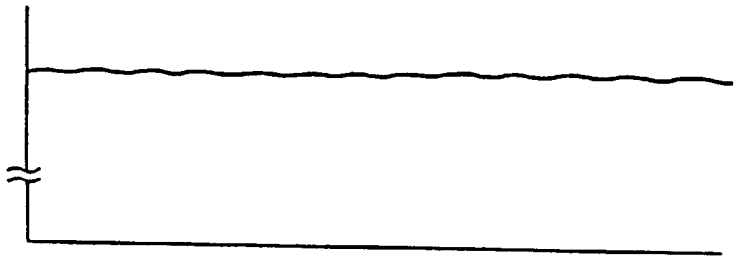

Although unevenness in the light intensity distribution of the horizontal scan line R-all is reduced as described above, a small ripple is still generated, as shown in FIG. 5A. As shown in FIG. 5B, a light intensity distribution of the horizontal scan line G-all also has a small ripple. As shown in FIG. 5C, a light intensity distribution of the horizontal scan line B-all also has a small ripple. Phases of these light intensity ripples are shifted relative to each other corresponding to the arrangements of the organic EL devices 20R, 20G and 20B.

When the light intensity distributions of the horizontal scan lines R-all, G-all and B-all are superposed during exposure, the ripples are cancelled by each other and a flat light intensity distribution can be obtained, as shown in FIG. SD. That is, by shifting the arrangements of the organic EL devices 20R, 20G and 20B within a range of acceptable dispersion of positions of the three colors, the unevenness can be further reduced in the exposing apparatus 1. Although the present embodiment has been described for exposing with red light, green light and blue light, the exposure may be carried out using light of other colors. For example, lights of the three colors: cyan, magenta and yellow may be used, and from a viewpoint of visuality, are preferably arranged in an order of cyan-magenta-yellow or magenta-cyan-yellow.

The lines r1 and r2 of the SELFOC lenses 31R of the SLA 30 are also shifted relative to each other. Further, the lines g1 and g2 of the SELFOC lenses 31G are shifted relative to the lines r1 and r2 by the distance d2. Similarly, the lines b1 and b2 of the SELFOC lenses 31B are shifted relative to the lines g1 and g2 by the distance d2. The light intensity ripples due to the SLAs 30 can thus be reduced in the exposing apparatus 1.

Another Embodiment

The present invention is not limited to the above described embodiment, and may have the structure described below. In the following description, parts which are the same as those described above are designated by the same reference numerals, and explanations which are the same are omitted.

Figure 6:
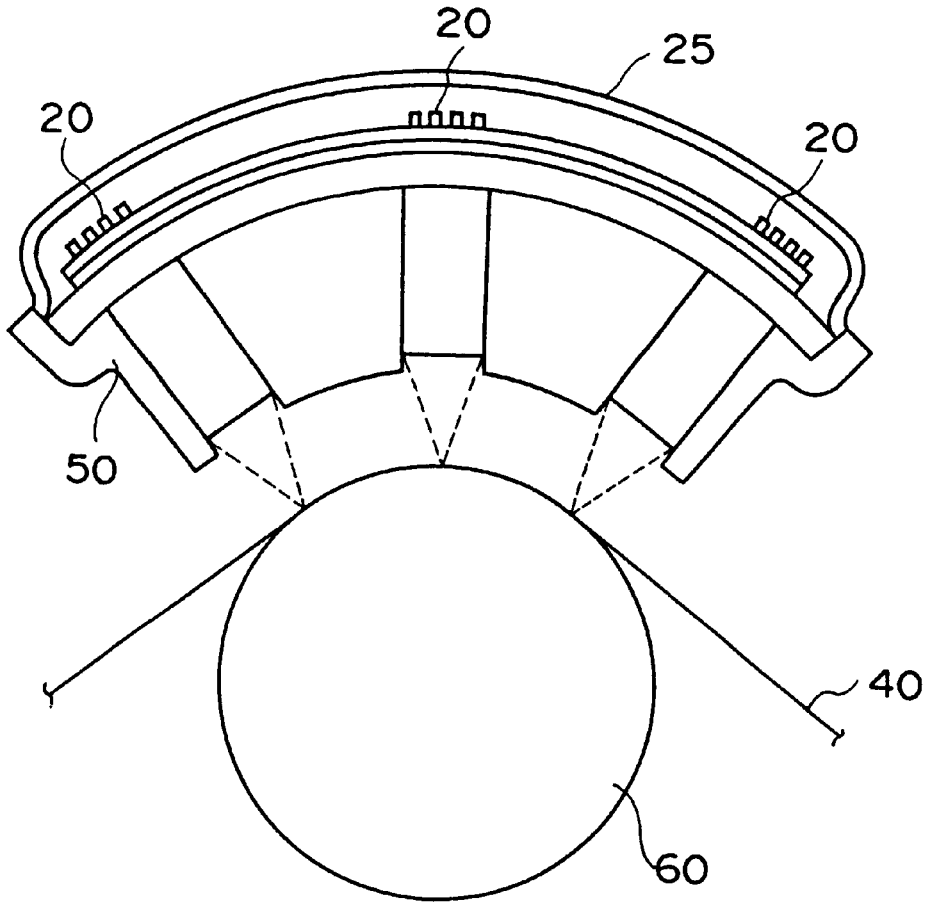
FIG. 6 is a sectional view showing a schematic structure of an exposing apparatus according to another embodiment of the present invention in which a photosensitive material is wound around an exposing drum to be exposed to light.

For example, as shown in FIG. 6, an exposing apparatus relating to the present embodiment is further provided with an exposing drum 60, around which the photosensitive material 40 is wound. A cross section of a transparent substrate 10 of the exposing apparatus 1 is curved in a circular arc shape at the outside of the exposing drum 60, with an axis of rotation of the exposing drum 60 as the center. Further, the support 50 supports the transparent substrate 10 as well as the SLAs 30R, 30G and 30B such that emitted lights are directed toward the axis of rotation of the exposing drum 60 and focused at a peripheral surface of the exposing drum 60.

Thus, the exposing apparatus can hold the photosensitive material 40 in position with the photosensitive surface of the material free from contact even if the photosensitive material 40 is long. Further, this structure can be readily adapted for use in an electrophotographic system.

Figure 7:
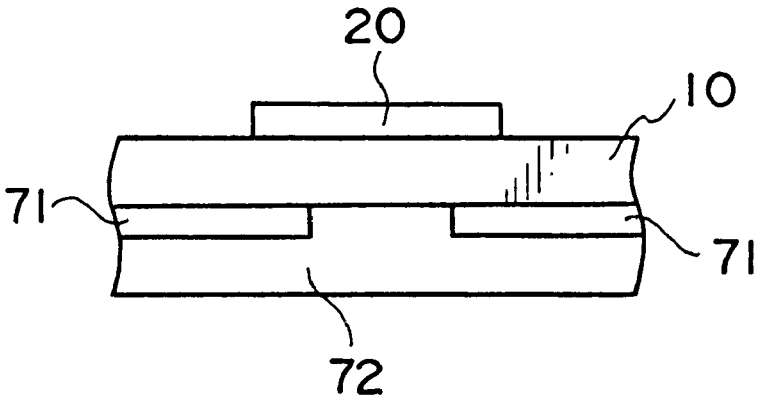
FIG. 7 is a sectional view showing a light shielding film and a light reshaping diffusion plate provided at a light emission side of the transparent substrate.

Furthermore, various parts may be provided around the organic EL devices 20. For example, as shown in FIG. 7, a light shielding film 71 for regulating the light from the organic EL devices 20 in a predetermined direction may be provided at the light emission side of the transparent substrate 10. This can prevent crosstalk between lights emitted from respective organic EL devices 20. A light pattern shaping diffusion plate 72 may also be provided at the light emission side of the transparent substrate 10.

Figure 8:
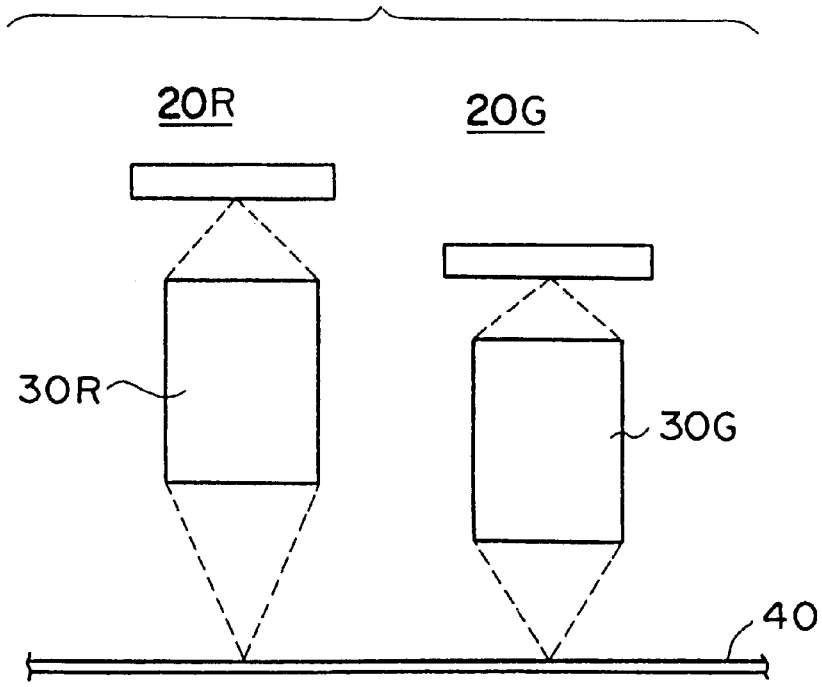
FIG. 8 is a schematic sectional view showing the exposing apparatus when heights at which the SLAs are disposed are changed for each color of emitted lights.

In addition, as shown in FIG. 8, the SLAs 30 (30R, 30G) may be disposed at different heights depending on the colors of emitted lights from the organic EL devices 20. Further, chromatic aberration-correcting type SLAs 30 may be used. This enables adjustment to cause light to focus on the photosensitive material 40.

The present invention is provided with a plurality of organic electroluminescent devices arranged with a predetermined spacing in a predetermined direction so as to form a plurality of linear arrays. By shifting the linear arrays relative to each other in the direction of arrangement so that at least portions of the respective electroluminescent devices are overlapped in the direction perpendicular to the direction of arrangement, dispersion of properties of the respective organic electroluminescent devices can be cancelled and consistent light can be obtained.

What is claimed is:

1. An exposing apparatus comprising:

a transparent substrate; and a plurality of rows of organic electroluminescent devices, each row including the organic electroluminescent devices disposed according to a predetermined spacing so that the electroluminescent devices are provided with a space between themselves and such that all of the electroluminescent devices in at least one row are operative to emit the same color of light, the rows being disposed on a surface of the transparent substrate and displaced relative to each other, such that at least one of the organic electroluminescent devices in one of the rows only partially overlaps at least one organic electroluminescent device in another of the rows with respect to the direction of the rows.

2. The exposing apparatus according to claim 1, wherein the position of each organic electroluminescent device in one of the rows substantially corresponds to the position of at least one organic electroluminescent device in another of the rows with respect to the direction of the rows, and a pixel is formed using at least two of the organic electroluminescent devices.

3. The exposing apparatus according to claim 2, wherein the organic electroluminescent devices comprise at least two types, each type arranged in rows according to the predetermined spacing, each row of the first type being offset by a predetermined amount with respect to the direction of the rows relative to each row of the second type so as to form a plurality of linear arrays of different organic electroluminescent device types on the transparent substrate, wherein the types of organic electroluminescent devices emit light in mutually different wavelength ranges, the transparent substrate consists essentially of a single substrate, and the arrays are shifted relative to each other such that each organic electroluminescent device in the array of one type of organic electroluminescent devices at most partially overlaps an organic electroluminescent device in the array of another type of organic electroluminescent devices with respect to the direction of the rows.

4. The exposing apparatus according to claim 2, further comprising a lens array including a plurality of lenses arranged opposing the rows so as to form lens rows, the positions of the lenses being shifted relative to each other from one lens row to another such that each lens in one of the lens rows at most partially overlaps a lens in another of the lens rows with respect to the direction of the rows, and the lenses being adapted for exposing a photosensitive material with light emitted from the organic electroluminescent devices.

5. The exposing apparatus according to claim 2, further comprising an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

6. The exposing apparatus according to claim 1, wherein the organic electroluminescent devices comprise at least two types, each type arranged in rows according to the predetermined spacing, each row of the first type being offset by a predetermined amount with respect to the direction of the rows relative to each row of the second type so as to form a plurality of linear arrays of different organic electroluminescent device types on the transparent substrate, wherein the types of organic electroluminescent devices emit light in mutually different wavelength ranges, the transparent substrate consists essentially of a single substrate, and the arrays are shifted relative to each other such that each organic electroluminescent device in the array of one type of organic electroluminescent devices at most partially overlaps an organic electroluminescent device in the array of another type of organic electroluminescent devices with respect to the direction of the rows.

7. The exposing apparatus according to claim 6, further comprising a lens array including a plurality of lenses arranged opposing the rows so as to form lens rows, the positions of the lenses being shifted relative to each other from one lens row to another such that each lens in one of the lens rows at most partially overlaps a lens in another of the lens rows with respect to the direction of the rows, and the lenses being adapted for exposing a photosensitive material with light emitted from the organic electroluminescent devices.

8. The exposing apparatus according to claim 6, further comprising an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

9. The exposing apparatus according to claim 1, further comprising a lens array including a plurality of lenses arranged opposing the rows so as to form lens rows, the positions of the lenses being shifted relative to each other from one lens row to another such that each lens in one of the lens rows at most partially overlaps a lens in another of the lens rows with respect to the direction of the rows, and the lenses being adapted for exposing a photosensitive material with light emitted from the organic electroluminescent devices.

10. The exposing apparatus according to claim 9, further comprising an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

11. The exposing apparatus according to claim 1, further comprising an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

12. The exposing apparatus according to claim 1, wherein each of the organic electroluminescent devices in one of the rows partially overlaps at least one corresponding organic electroluminescent device in another of the rows.

13. An apparatus for exposing a photosensitive material, the apparatus comprising:

a substrate; and a set of element rows formed by arranging a plurality of rows on the substrate in a direction substantially perpendicular to the rows, each row being formed by arranging a plurality of elements which emit light in the same wavelength range along the direction of the rows, the elements being spaced at first intervals, and the rows being displaced relative to each other with respect to the direction of the rows at second intervals which are smaller than the first intervals.

14. The apparatus according to claim 13, wherein there is a plurality of the set of element rows, arranged in the direction substantially perpendicular to the rows.

15. The apparatus according to claim 14, wherein each set of element rows is formed using a plurality of the light emitting elements, the plurality of emitting elements emitting light in mutually different wavelength ranges, and the respective sets are arranged in the direction substantially perpendicular to the rows and displaced relative to each other with respect to the direction of the rows at third intervals which are smaller than the second intervals.

16. The apparatus according to claim 14, further comprising a plurality of lenses disposed between the photosensitive material and the substrate, light from the light emitting elements irradiating the photosensitive material via the lenses, the plurality of lenses being provided in the form of a set of lens rows comprising a plurality of linear lens rows, each row including a plurality of lenses arranged along the direction of the rows, the lens rows being displaced relative to each other by a predetermined distance with respect to the direction of the rows.

17. The apparatus according to claim 16, wherein there is a plurality of the set of lens rows provided in correspondence with sets of light emitting elements, which sets of light emitting elements emit light of mutually different wavelengths.

18. The apparatus according to claim 17, wherein the sets of lens rows respectively corresponding to the sets of light emitting elements are disposed at different distances from a surface of the photosensitive material.

19. The apparatus according to claim 17, wherein the lenses are of a chromatic aberration correction type.

20. The apparatus according to claim 13, further comprising a light shielding film provided at a light emission side of the substrate for regulating light from the elements.

21. The apparatus according to claim 20, further comprising a light pattern shaping diffusion plate provided at the light emission side of the substrate.

22. An exposing apparatus comprising:

a transparent substrate;

a plurality of rows of organic electroluminescent devices, each row including the organic electroluminescent devices disposed according to a predetermined spacing, the rows being disposed on a surface of the transparent substrate and displaced relative to each other, such that at least one of the organic electroluminescent devices in one of the rows only partially overlaps at least one organic electroluminescent device in another of the rows with respect to the direction of the rows; and a lens array including a plurality of lenses arranged opposing the rows so as to form lens rows, the positions of the lenses being shifted relative to each other from one lens row to another such that each lens in one of the lens rows at most partially overlaps a lens in another of the lens rows with respect to the direction of the rows, and the lenses being adapted for exposing a photosensitive material with light emitted from the organic electroluminescent devices.

23. The exposing apparatus according to claim 22, further comprising an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

24. An exposing apparatus comprising:

a transparent substrate;

a plurality of rows of organic electroluminescent devices, each row including the organic electroluminescent devices disposed according to a predetermined spacing, the rows being disposed on a surface of the transparent substrate and displaced relative to each other, such that at least one of the organic electroluminescent devices in one of the rows only partially overlaps at least one organic electroluminescent device in another of the rows with respect to the direction of the rows; and an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

25. An exposing apparatus comprising:

a transparent substrate;

a plurality of rows of organic electroluminescent devices, each row including the organic electroluminescent devices disposed according to a predetermined spacing, the rows being disposed on a surface of the transparent substrate and displaced relative to each other, such that at least one of the organic electroluminescent devices in one of the rows only partially overlaps at least one organic electroluminescent device in another of the rows with respect to the direction of the rows, wherein the position of each organic electroluminescent device in one of the rows substantially corresponds to the position of at least one organic electroluminescent device in another of the rows with respect to the direction of the rows, and a pixel is formed using at least two of the organic electroluminescent devices; and a lens array including a plurality of lenses arranged opposing the rows so as to form lens rows, the positions of the lenses being shifted relative to each other from one lens row to another such that each lens in one of the lens rows at most partially overlaps a lens in another of the lens rows with respect to the direction of the rows, and the lenses being adapted for exposing a photosensitive material with light emitted from the organic electroluminescent devices.

26. An exposing apparatus comprising:

a transparent substrate;

a plurality of rows of organic electroluminescent devices, each row including the organic electroluminescent devices disposed according to a predetermined spacing, the rows being disposed on a surface of the transparent substrate and displaced relative to each other, such that each organic electroluminescent device in one of the rows at least partially overlaps at least one organic electroluminescent device in another of the rows with respect to the direction of the rows, wherein the position of each organic electroluminescent device in one of the rows substantially corresponds to the position of at least one organic electroluminescent device in another of the rows with respect to the direction of the rows, and a pixel is formed using at least two of the organic electroluminescent devices; and an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

27. An exposing apparatus comprising:

a transparent substrate;

a plurality of rows of organic electroluminescent devices, each row including the organic electroluminescent devices disposed according to a predetermined spacing, the rows being disposed on a surface of the transparent substrate and displaced relative to each other, such that at least one of the organic electroluminescent devices in one of the rows only partially overlaps at least one organic electroluminescent device in another of the rows with respect to the direction of the rows, wherein the organic electroluminescent devices comprise at least two types, each type arranged in rows according to the predetermined spacing, each row of the first type being offset by a predetermined amount with respect to the direction of the rows relative to each row of the second type so as to form a plurality of linear arrays of different organic electroluminescent device types on the transparent substrate, wherein the types of organic electroluminescent devices emit light in mutually different wavelength ranges, the transparent substrate consists essentially of a single substrate, and the arrays are shifted relative to each other such that each organic electroluminescent device in the array of one type of organic electroluminescent devices at most partially overlaps an organic electroluminescent device in the array of another type of organic electroluminescent devices with respect to the direction of the rows; and a lens array including a plurality of lenses arranged opposing the rows so as to form lens rows, the positions of the lenses being shifted relative to each other from one lens row to another such that each lens in one of the lens rows at most partially overlaps a lens in another of the lens rows with respect to the direction of the rows, and the lenses being adapted for exposing a photosensitive material with light emitted from the organic electroluminescent devices.

28. An exposing apparatus comprising:

a transparent substrate;

a plurality of rows of organic electroluminescent devices, each row including the organic electroluminescent devices disposed according to a predetermined spacing, the rows being disposed on a surface of the transparent substrate and displaced relative to each other, such that each organic electroluminescent device in one of the rows at least partially overlaps at least one organic electroluminescent device in another of the rows with respect to the direction of the rows, wherein the organic electroluminescent devices comprise at least two types, each type arranged in rows according to the predetermined spacing, each row of the first type being offset by a predetermined amount with respect to the direction of the rows relative to each row of the second type so as to form a plurality of linear arrays of different organic electroluminescent device types on the transparent substrate, wherein the types of organic electroluminescent devices emit light in mutually different wavelength ranges, the transparent substrate consists essentially of a single substrate, and the arrays are shifted relative to each other such that each organic electroluminescent device in the array of one type of organic electroluminescent devices at most partially overlaps an organic electroluminescent device in the array of another type of organic electroluminescent devices with respect to the direction of the rows; and an exposing drum, around which a photosensitive material is wound and exposed, wherein the transparent substrate is formed at the outside of the exposing drum with a cross section of the transparent substrate being formed in a circular arch shape whose center is at an axis of rotation of the exposing drum.

* * * * *